US012533570B1

(12) United States Patent
Deasy

(10) Patent No.: US 12,533,570 B1
(45) Date of Patent: Jan. 27, 2026

(54) TOSS GAME ASSEMBLY AND METHOD THEREFOR

(71) Applicant: Bombhole LLC, Irwin, PA (US)

(72) Inventor: Corey Deasy, Irwin, PA (US)

( * ) Notice: Subject to any disclaimer, the term of this patent is extended or adjusted under 35 U.S.C. 154(b) by 0 days.

(21) Appl. No.: 19/176,982

(22) Filed: Apr. 11, 2025

(51) Int. Cl.
*A63F 9/02* (2006.01)
*A63F 7/02* (2006.01)
*A63F 7/34* (2006.01)

(52) U.S. Cl.
CPC ..... *A63F 9/0204* (2013.01); *A63F 7/02* (2013.01); *A63F 7/34* (2013.01); *A63F 9/0278* (2013.01); *A63F 2007/341* (2013.01); *A63F 2007/345* (2013.01); *A63F 2250/027* (2013.01)

(58) Field of Classification Search
CPC ..... A63F 9/0204; A63F 7/02; A63F 7/34
See application file for complete search history.

(56) References Cited

U.S. PATENT DOCUMENTS 268,895 A * 12/1882 Hoar ..... A63F 9/0204 273/382
611,828 A * 10/1898 Brown ..... A63F 9/0204 273/355
788,266 A * 4/1905 King et al. ..... F42B 8/02 102/447
1,123,051 A * 12/1914 Whitman ..... A63F 9/0204 273/382
1,186,206 A * 6/1916 Kelley ..... A63F 9/0204 273/390
1,442,054 A * 1/1923 Dixon ..... A63F 9/0204 473/196
2,119,572 A 6/1938 Creswell
2,552,446 A * 5/1951 O'Conner ..... A63F 9/0204 273/390
2,977,429 A 3/1961 Zimmerman
3,036,833 A * 5/1962 Wilson ..... A63F 9/0204 D21/302
3,368,814 A * 2/1968 Kolwicz ..... A63F 9/0204 273/342
3,790,174 A 2/1974 Skillern
4,927,160 A 5/1990 Nichol et al.
5,031,919 A 7/1991 Dixon
5,526,750 A * 6/1996 Poor ..... F41A 9/47 102/431
9,707,461 B1 7/2017 McKnight
D981,492 S 3/2023 Zurmuehlen
2018/0043243 A1* 2/2018 Miller ..... A63F 7/0023
(Continued)

FOREIGN PATENT DOCUMENTS

GB 191503189 A * 1/1916 ..... A63F 9/0204
WO WO-9533176 A1 * 12/1995 ..... F42B 8/28
WO WO2024129527 A 6/2024

*Primary Examiner* — Raleigh W Chiu

(57) ABSTRACT

A toss game assembly includes a target, a projectile, an impact-responsive element, and a collector. The target has a play surface. The projectile is designed to be tossed onto the play surface. The impact-responsive element is coupled to the target and positioned on the play surface. The impact-responsive element includes a pyrotechnic material that is designed to produce a pyrotechnic effect when the impact-responsive element is struck by the projectile. The collector is coupled to the target. The collector is designed to collect the projectile moving along the play surface after being tossed for retrieval and reuse.

17 Claims, 10 Drawing Sheets

(56) References Cited

U.S. PATENT DOCUMENTS

| | | | | |
|---|---|---|---|---|
| 2018/0366027 | A1* | 12/2018 | Boswell | A63F 7/022 |
| 2020/0282278 | A1 | 9/2020 | McCuen | |
| 2022/0096909 | A1 | 3/2022 | Russell et al. | |
| 2024/0350897 | A1* | 10/2024 | Kirkland | A63F 9/0204 |

* cited by examiner

TOSS GAME ASSEMBLY AND METHOD THEREFOR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tossing games and more particularly pertains to a new toss game assembly. Tossing games, like cornhole or lawn darts, are fun recreational games. Such games usually do not include additional audio or visual effects to enhance game play. Some games include electronic sounds and lights. However, none of these games includes an explosive or pyrotechnic effect to enhance the game play. The new toss game assembly includes an impact-responsive element that, when struck by a tossed projectile such as a ball, is triggered or detonated to produce an explosive or pyrotechnic effect, including visible flames or sparks and audible pops or bangs. Such effects can be used as part of a scoring system, wherein triggering of the effect results in greater scoring in addition to the excitement of triggering the effect.

(2) Description of Related Art Including Information Disclosed Under 37 CFR 1.97 and 1.98

The prior art relates to tossing games. The prior art, as best understood, does not disclose a toss game assembly that includes a target, a projectile, an impact-responsive element, and a collector, wherein the impact-responsive element includes a pyrotechnic material that is designed to produce a pyrotechnic effect when the impact-responsive element is struck by the projectile, and the collector is designed to collect the projectile moving along the play surface after being tossed for retrieval and reuse.

BRIEF SUMMARY OF THE INVENTION

An embodiment of the disclosure meets the needs presented above in a toss game assembly generally comprising a target, a projectile, an impact-responsive element, and a collector. The target has a play surface. The projectile is designed to be tossed onto the play surface. The impact-responsive element is coupled to the target and positioned on the play surface. The impact-responsive element includes a pyrotechnic material that is designed to produce a pyrotechnic effect when the impact-responsive element is struck by the projectile. The collector is coupled to the target. The collector is designed to collect the projectile moving along the play surface after being tossed for retrieval and reuse.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
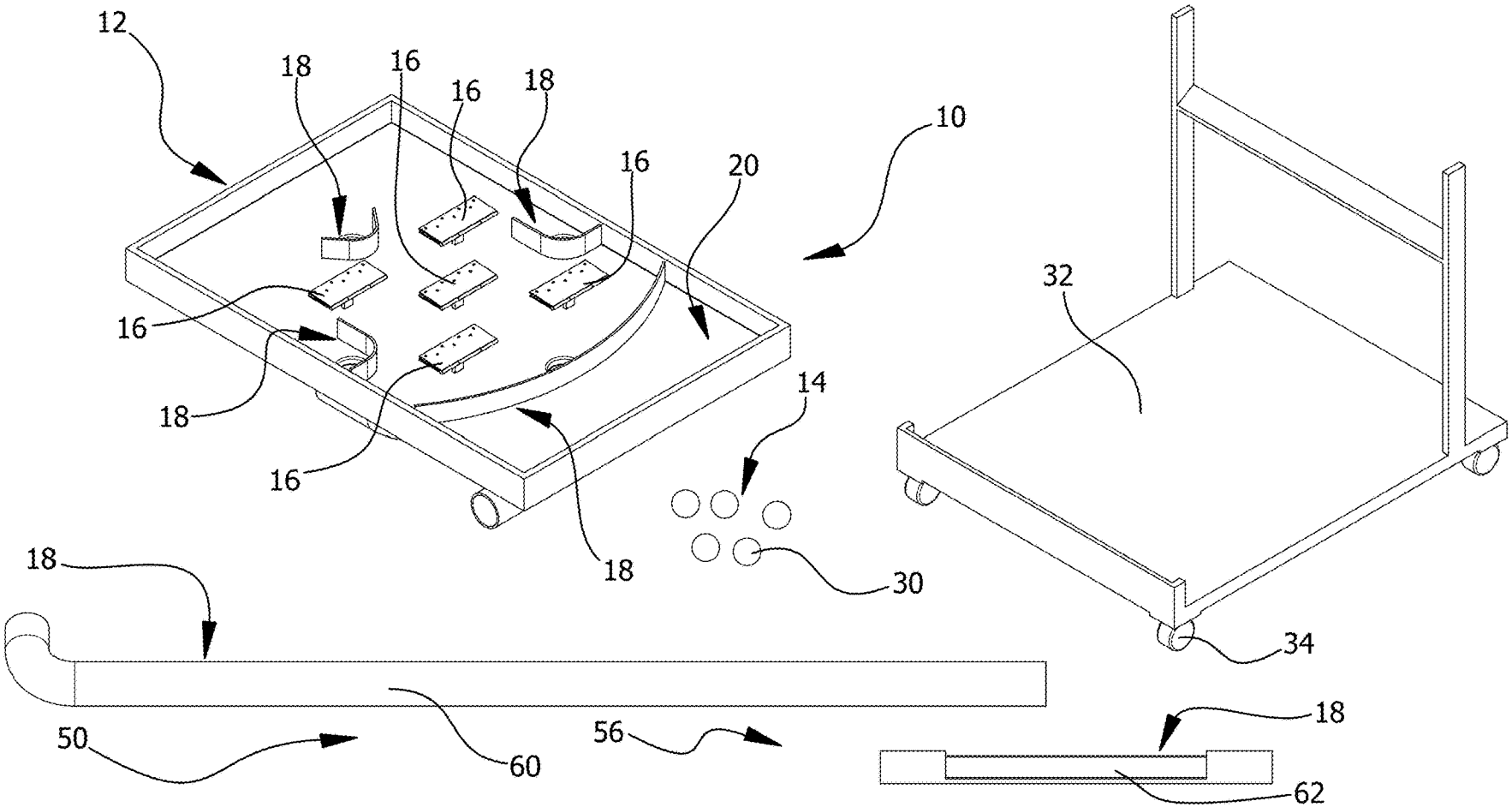
FIG. 1 is a disassembled perspective view of a toss game assembly according to an embodiment of the disclosure.

With reference now to the drawings, and in particular to FIGS. 1 through 10 thereof, a new toss game assembly embodying the principles and concepts of an embodiment of the disclosure and generally designated by the reference numeral 10 will be described.

Figure 7:
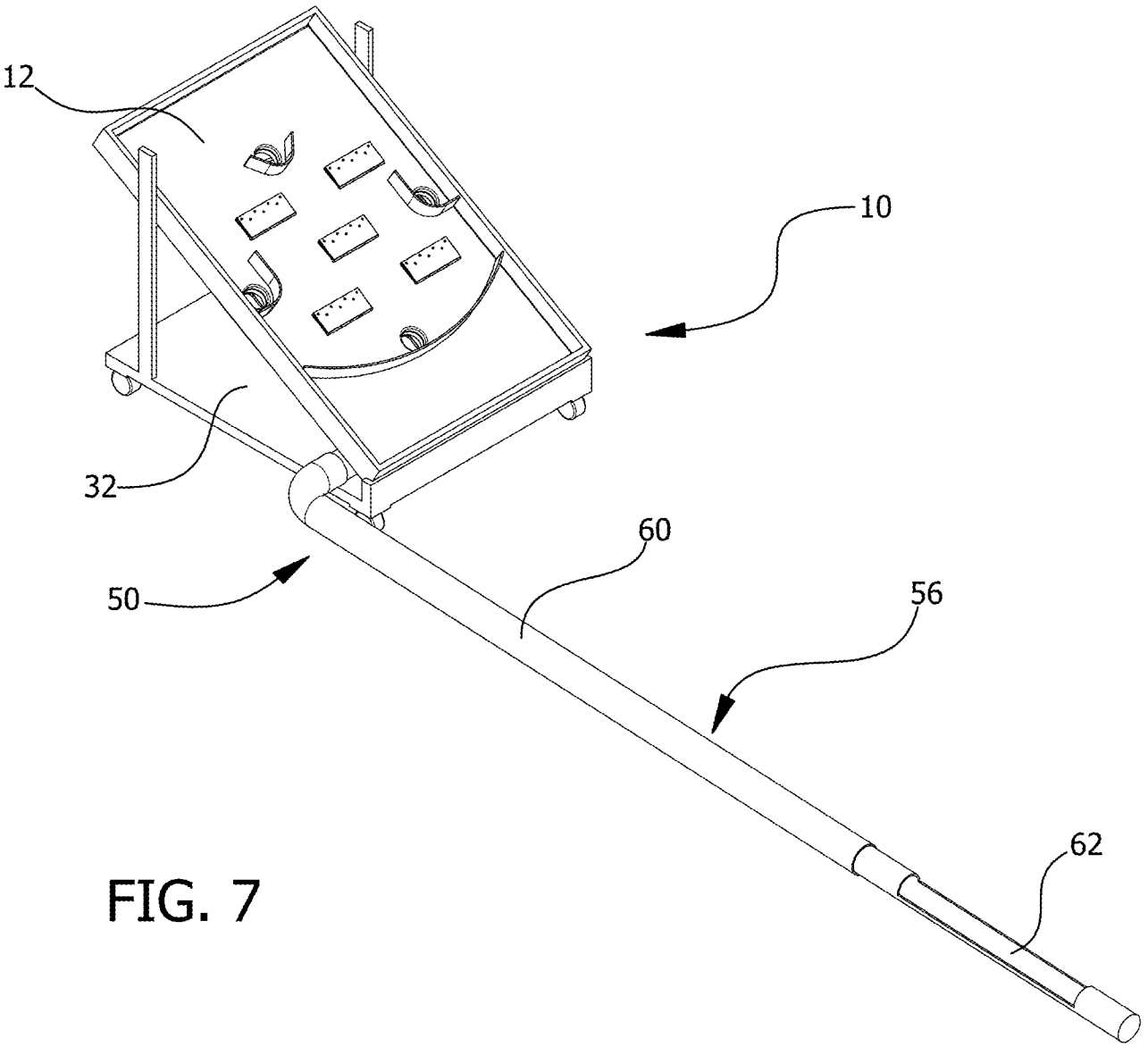
FIG. 7 is a perspective view of an embodiment of the disclosure.
Figure 8:
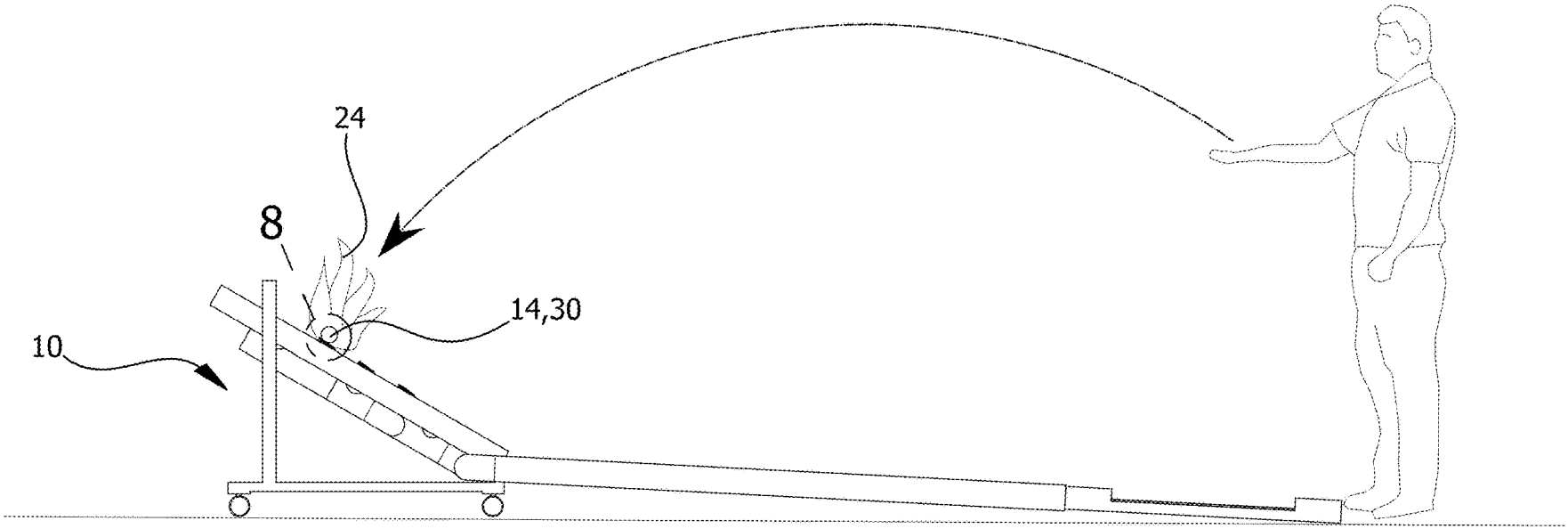
FIG. 8 is a perspective view of an embodiment of the disclosure in use.

As best illustrated in FIGS. 1 through 10, the toss game assembly 10 generally comprises a target 12, a projectile 14, an impact-responsive element 16, and a collector 18. The target 12 has a play surface 20. The projectile 14 is designed to be tossed onto the play surface 20, as shown in FIG. 8. The impact-responsive element 16 is coupled to the target 12 and positioned on the play surface 20. The impact-responsive element 16 includes a pyrotechnic material 22, as shown in the exemplary embodiment in FIGS. 3 and 4, that is designed to produce a pyrotechnic effect 24 when the impact-responsive element 16 is struck by the projectile 14, as shown in the exemplary embodiment in FIG. 9. The collector 18 is coupled to the target 12. The collector 18 is designed to collect the projectile 14 moving along the play surface 20 after being tossed for retrieval and reuse.

As used herein, "pyrotechnic material" includes any explosive material that is designed to produce audible and/or visible effects after being triggered or detonated or ignited. As used herein, "novelty pyrotechnic" refers to any type of minor or mild explosive, small fireworks safe for public use, and toy explosives or ammunition, even though terms such as "firework," "pyrotechnic," and "explosive" can be defined differently depending on the jurisdiction and laws regulating the sale and use of such items and materials. As used herein, "pyrotechnic effect" refers to the resulting audible and/or visible effects, which can include sounds, such as bangs, pops, or booms, and/or visuals, such as flames, sparks, or flashes. In the exemplary embodiment in FIGS. 3 and 4, the pyrotechnic material 22 is designed to produce a sound and a flame when triggered. The pyrotechnic material 22 includes an impact-responsive novelty pyrotechnic 26 and a nitrocellulose paper 28 positioned immediately adjacent the impact-responsive novelty pyrotechnic 26. In the example in FIGS. 3 and 4, the impact-responsive novelty pyrotechnic 26 is a ring cap for a toy cap gun, which generally contains small amounts of shock-sensitive explosive compound (not shown), typically Armstrong's mixture, that can be ignited when struck with sufficient force. The chemicals in the ring cap are flammable and produce sufficient heat to ignite the nitrocellulose paper 28. Nitrocellulose paper, commonly referred to as flash paper, burns very quickly and produces substantial flame without any ash or smoke. The combination of the impact-responsive novelty pyrotechnic 26 and the nitrocellulose paper 28 produces an entertaining pyrotechnic effect 24 of flame and sound that is safe and complies with most all fire safety regulations. In the exemplary embodiment in FIG. 4, the nitrocellulose has been folded over into a packet or pouch with the ends sealed, though a loose construction is also possible. In another possible embodiment, the cap ring is omitted and an amount of the shock-sensitive explosive compound is contained in the nitrocellulose paper 28. In one possible embodiment, the nitrocellulose paper 28 is omitted and only the cap ring or the shock-sensitive explosive compound is used. In another possible embodiment, other pyrotechnic materials could be used that are well known in the firework and pyrotechnic arts.

Figure 4:
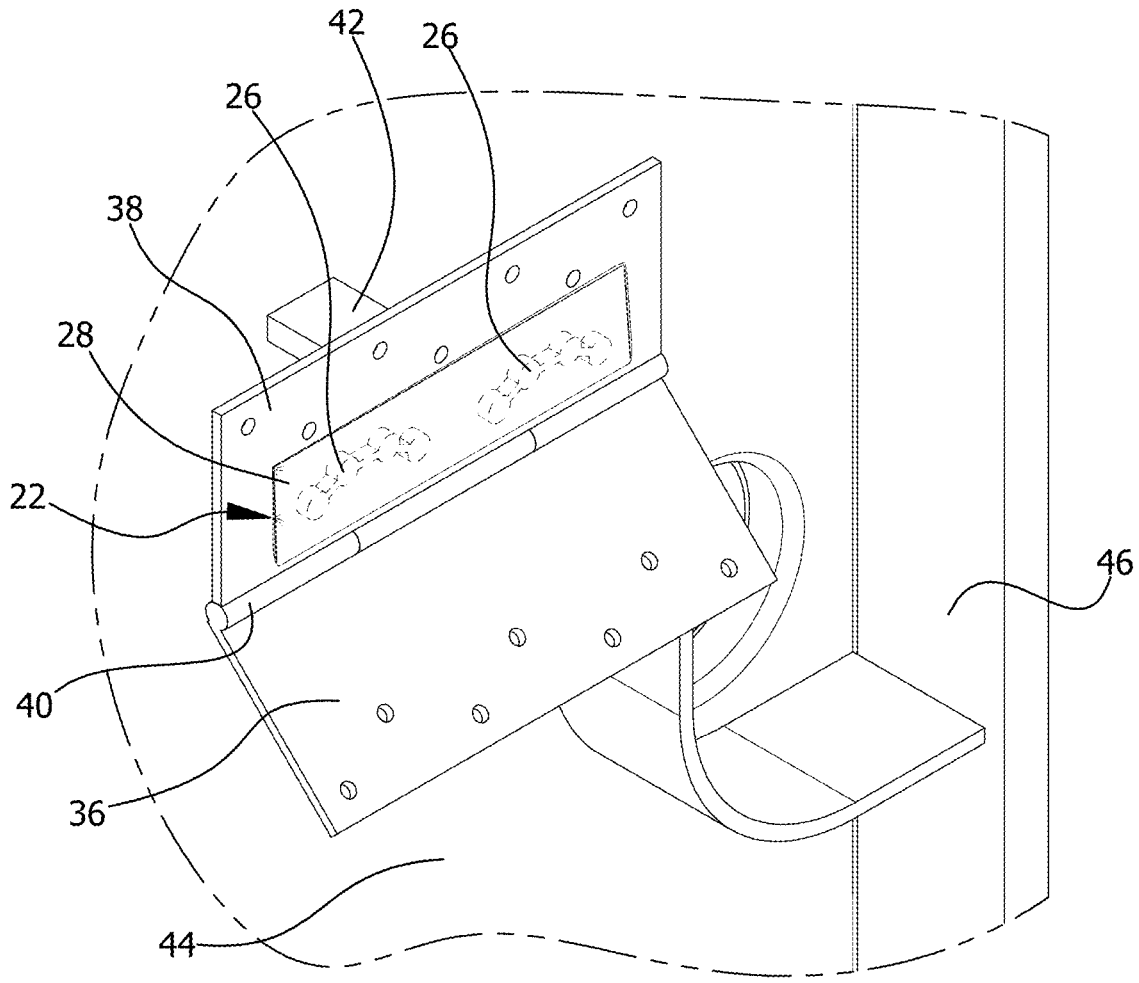
FIG. 4 is a close-up view of a component of an embodiment of the disclosure.
Figure 5:
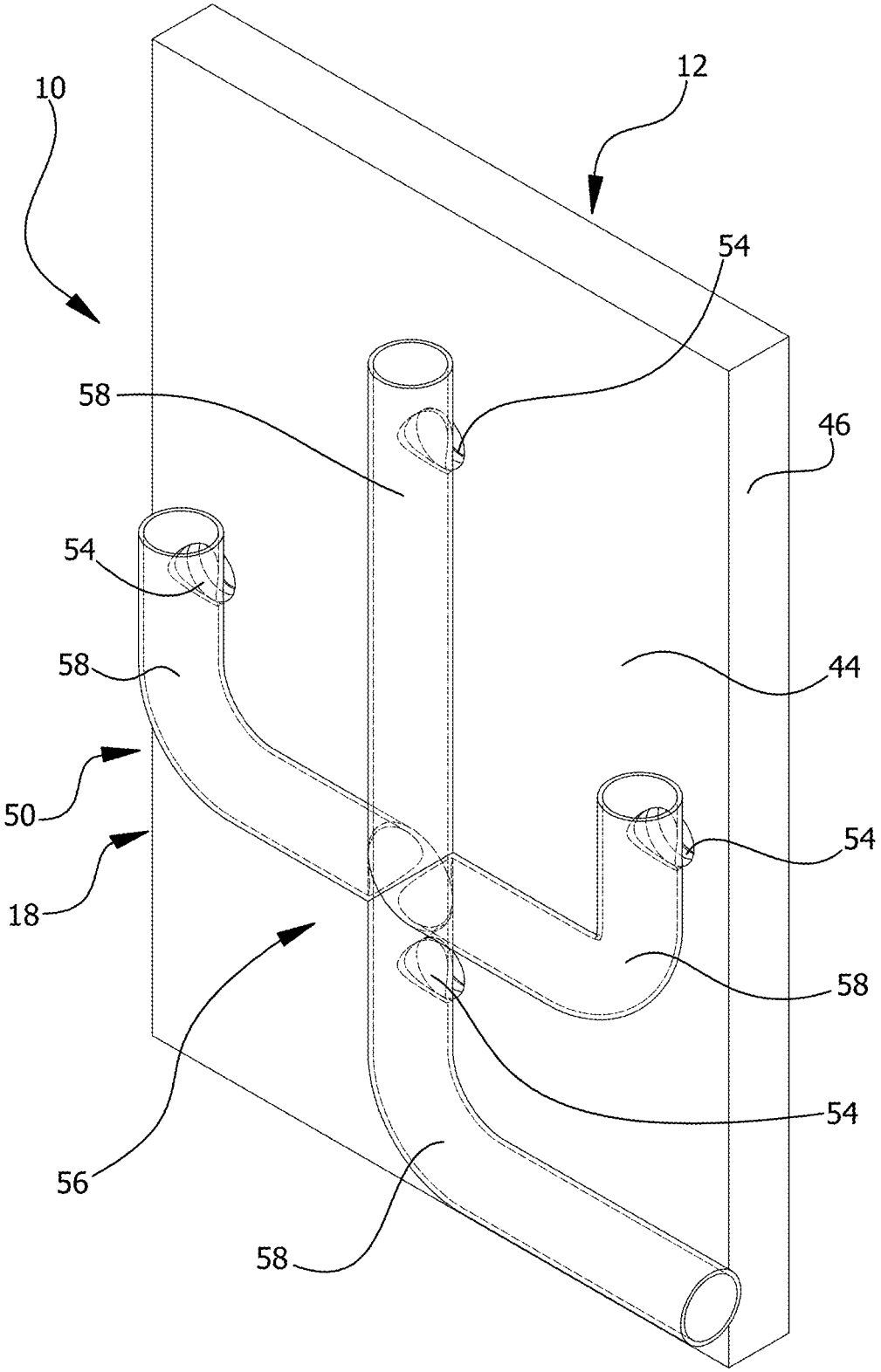
FIG. 5 is a rear perspective view of an embodiment of the disclosure.
Figure 6:
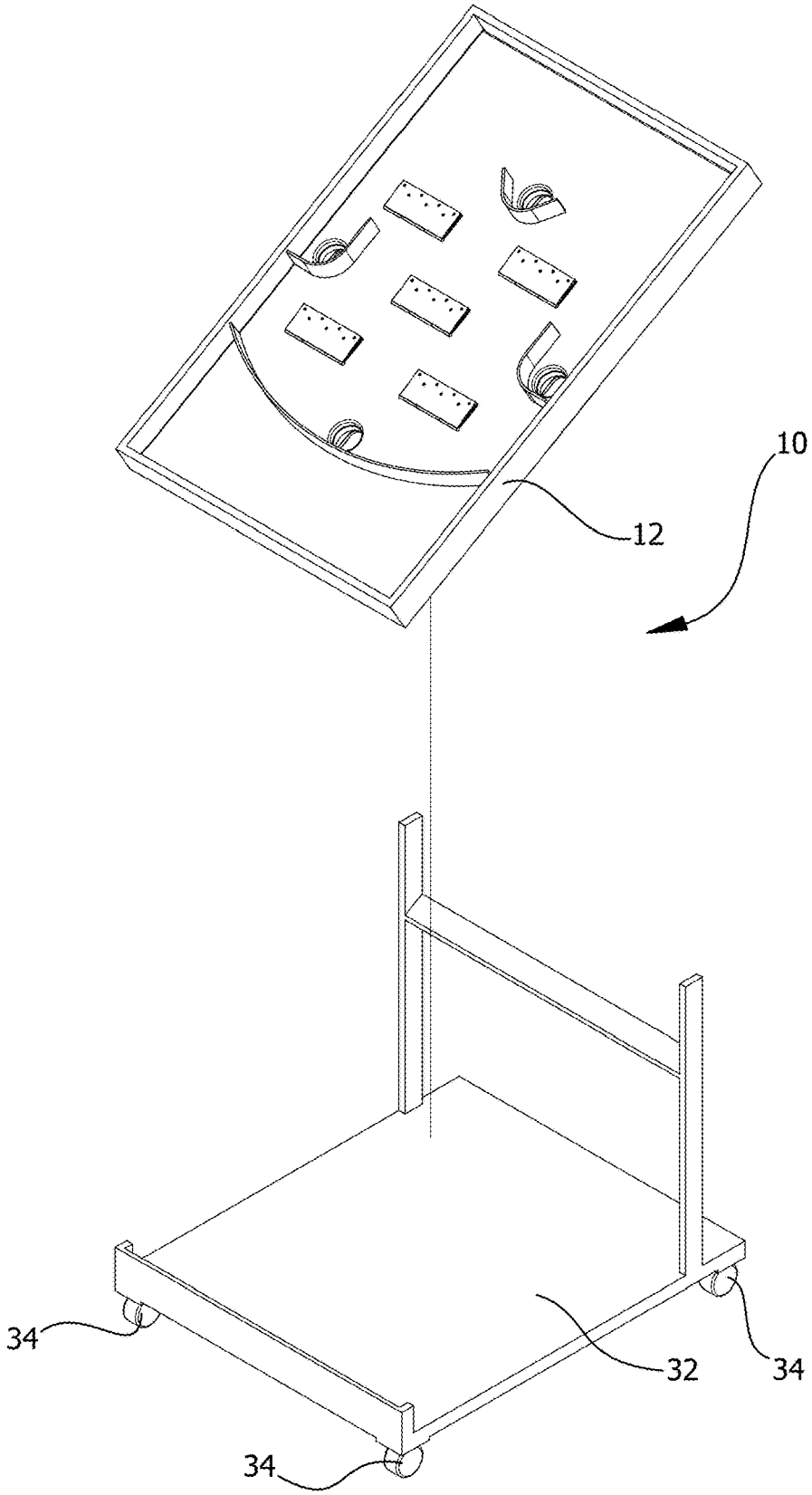
FIG. 6 is a perspective view of an embodiment of the disclosure.
Figure 9:
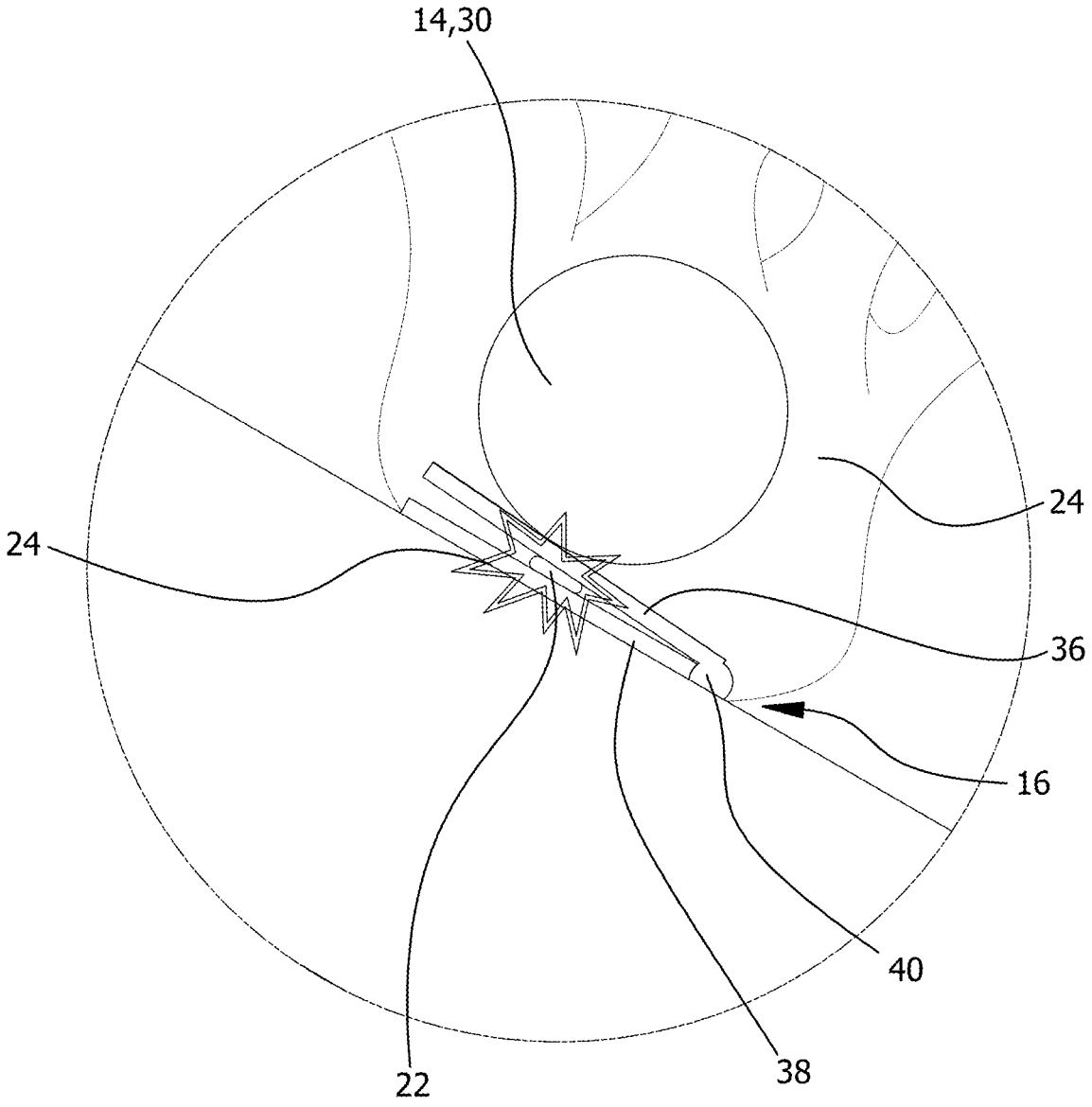
FIG. 9 is a close-up view of a component of an embodiment of the disclosure in use.
Figure 10:
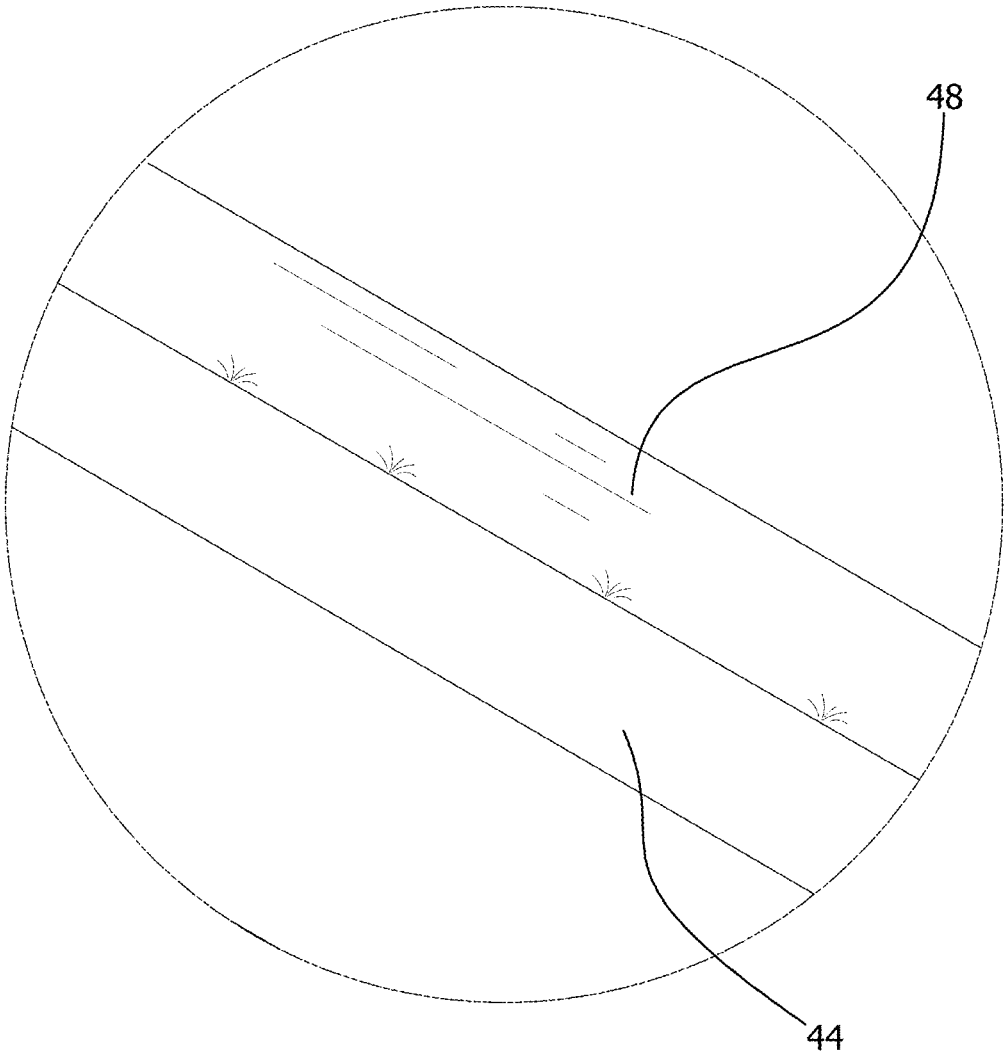
FIG. 10 is a cross-sectional view of a component of an embodiment of the disclosure.

In the exemplary embodiment in FIG. 4, the impact-responsive element 16 includes a strike plate 36. The pyrotechnic material 22 is placed under the strike plate 36 such that when the strike plate 36 is struck by the projectile 14 the pyrotechnic material 22 is triggered to produce the pyrotechnic effect 24, such as is shown in FIG. 9. In another possible embodiment, the impact-responsive element 16 could include a different impact mechanism other than a strike plate 36, such as a hammer-type structure, a driven rod, or a spring-loaded element that can be released. In another possible embodiment, the impact-responsive element 16 could be a mechanism with moving parts that can produce a spark to ignite the nitrocellulose, such as a flint and a steel wheel or similar element that can be moved by the impact of the projectile 14 to strike the flint and produce a spark. Essentially any mechanical structure that could transmit the impact forces to the shock-sensitive explosive compound and/or produce a spark for igniting the nitrocellulose could be utilized. In another possible embodiment, the impact-responsive element 16 could be connected to a trigger mechanism, such as a physical contact, electronic sensor, or similar trigger, which could be activated by the projectile 14 and in turn activate the impact-responsive element 16 to detonate the shock-sensitive explosive compound. In another possible embodiment, additional audio and visual effects, such as moving mechanical parts, electronic sound effects, and lights, could be included in the toss game assembly 10 for additional entertaining effects.

In the exemplary embodiment in FIG. 4, the impact-responsive element 16 includes a base plate 38 coupled to the target 12 and a hinge 40 coupled to the base plate 38. The strike plate 36 is pivotably coupled to the base plate 38 by the hinge 40. The pyrotechnic material 22 is positioned between the strike plate 36 and the base plate 38. The strike plate 36 is pivotable for insertion of the pyrotechnic material 22 between the strike plate 36 and the base plate 38 and for removal of the pyrotechnic material 22 after use.

Also in the exemplary embodiment in FIG. 4, the toss game assembly 10 further includes a projection 42, such as a post. The projection 42 is coupled to the target 12 and projects from the play surface 20. The impact-responsive element 16 is supported on the projection 42 a distance from the play surface 20. The impact-responsive element 16 alternatively could be mounted on the play surface 20 itself, or possibly in a recess below or flush with the play surface 20.

In the exemplary embodiment in FIG. 1, the projectile 14 is a ball 30. The ball 30 is weighted to increase the force generated by the ball 30 when striking the impact-responsive element 16. The ball 30 will be designed with sufficient mass and rigidity to trigger the impact-responsive element 16. The ball 30 could be made of steel, plastic, rubber, or other rigid material that is also fire-resistant, or possibly combinations of different materials, as long as the ball 30 effectively and reliably activates the impact-responsive element 16.

Figure 2:
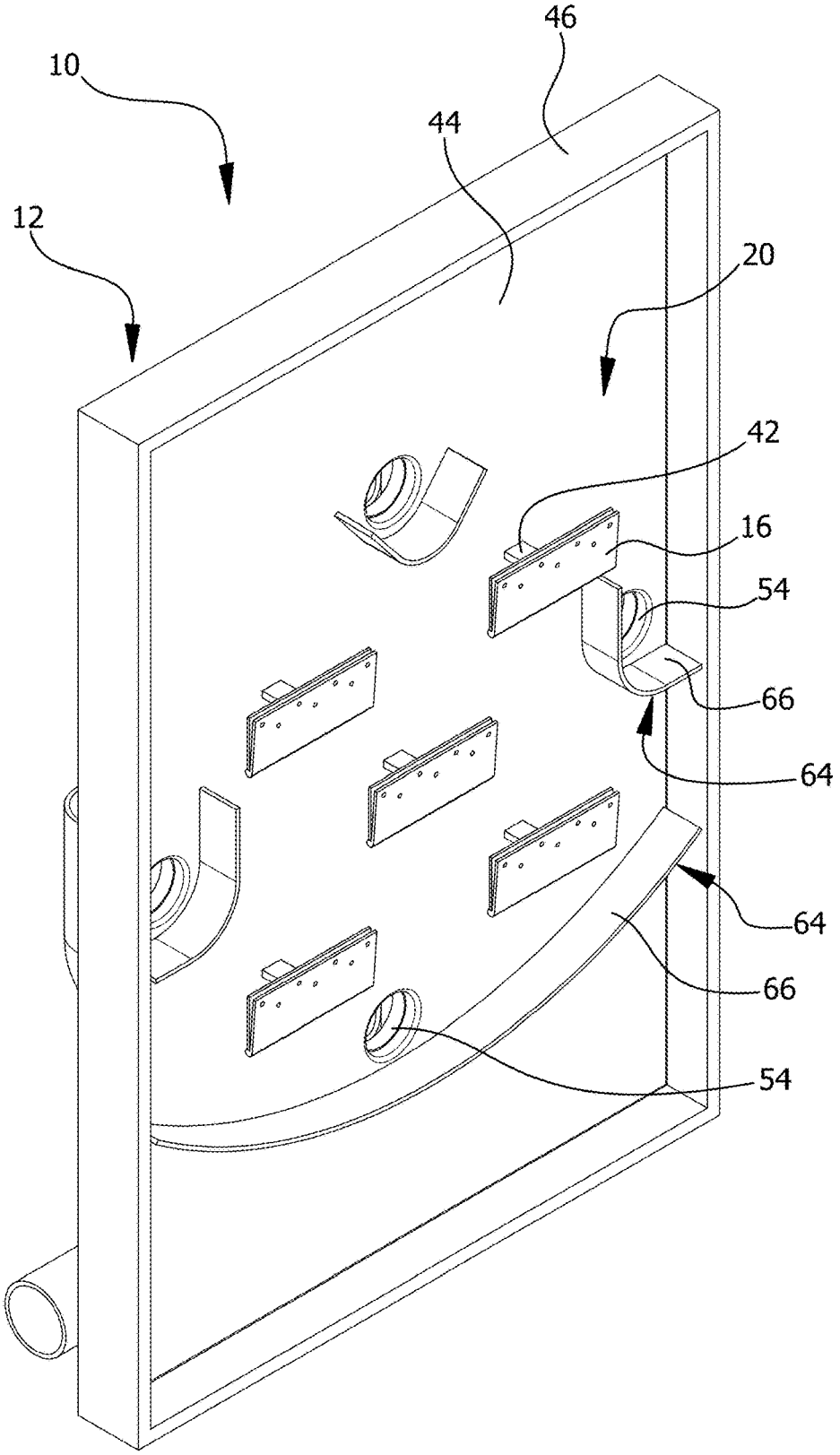
FIG. 2 is a front perspective view of an embodiment of the disclosure.
Figure 3:
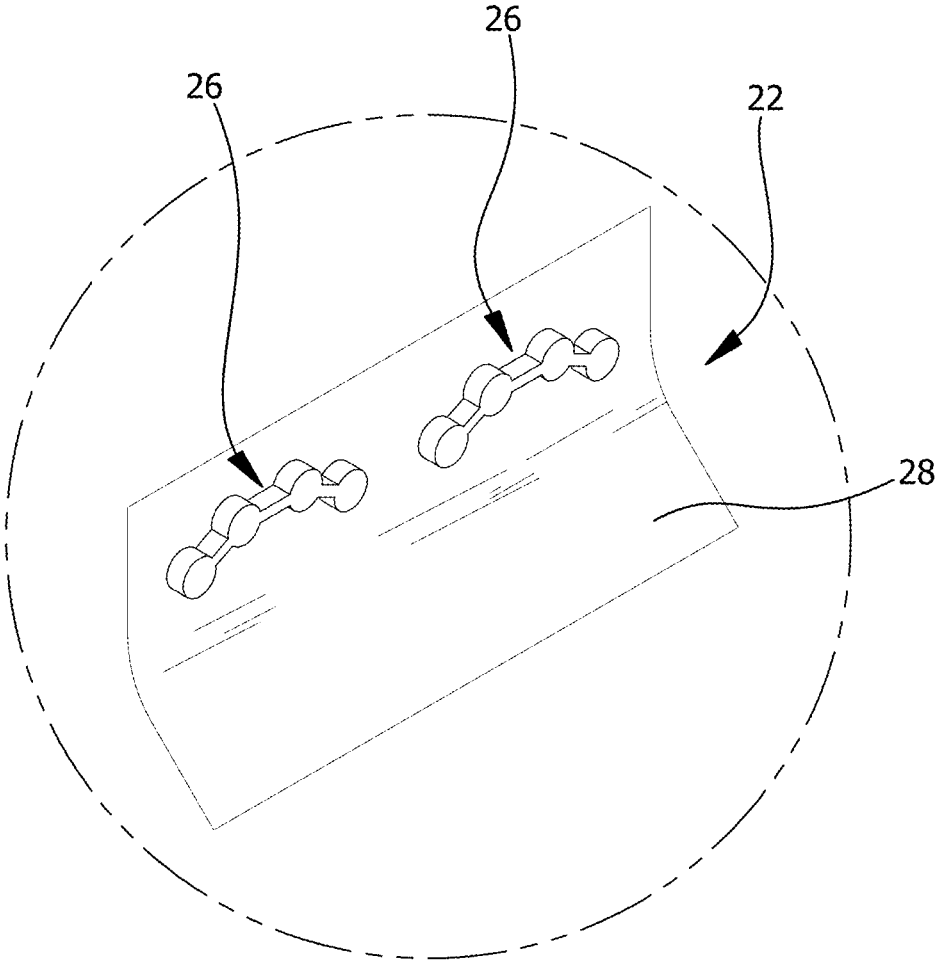
FIG. 3 is a close-up view of a component of an embodiment of the disclosure.

In the exemplary embodiment in FIG. 2, the target 12 includes a panel 44 and a perimeter wall 46 coupled to the panel 44 to define the play surface 20 on the panel 44. The perimeter wall 46 could be omitted in one possible embodiment, though the perimeter wall 46 is useful for containing the projectile 14 when tossed onto the play area. The panel 44 could be made of wood, metal, plastic, or other rigid material or combinations thereof. The panel 44 and the perimeter wall 46, as well as other components of the toss game assembly 10, in one possible embodiment may be coated with intumescent paint, which expands under heat to form a fire-resistant barrier, or constructed from inherently fire-resistant materials, such as steel, fire-treated wood, or composites, for safety reasons, though the pyrotechnic material 22 shown in the exemplary embodiment in FIG. 3 is designed to produce very minimal explosive or pyrotechnic effect 24 such that a fire risk would be minimal bordering on non-existent. The panel 44 could alternatively be made of a softer material for cushioning. In that regard, in the exemplary embodiment in FIG. 10, the toss game assembly 10 includes a cushioning material 48 that is positioned on the panel 44. The cushioning material 48 is designed to minimize bounce of the projectile 14 after impact on the panel 44 and to minimize sound produced by the projectile 14 striking the panel 44. The cushioning material 48 could be memory foam, foam rubber, gel, or similar materials. Whether cushioned or not, the panel 44 may optionally include fire-resistant features, such as a covering like a welder's blanket or a layer of fiberglass fabric over cushioning materials to mitigate flammability while preserving malleability, or a fire-resistant coating on rigid surfaces.

In the exemplary embodiment in FIGS. 1 and 7, the target 12 includes a frame 32 coupled to the panel 44 to hold the panel 44 at an angle to the horizontal. The frame 32 could include wheels 34 as shown such that the frame 32 is portable, though the frame 32 could easily be part of a fixed or stationary installation without wheels 34. In one possible embodiment, the target 12 could be positioned at virtually any angle with respect to the horizontal in the range of zero degrees to ninety degrees, which range includes all values in whole numbers and tenths of a degree.

The collector 18 includes a return device 50 designed to return the projectile 14 to a tossing area 52. The panel 44 includes an orifice 54 through which the projectile 14 may pass for scoring and/or collection, as is well known in tossing games. The return device 50 is coupled to the panel 44 beneath the orifice 54 to receive the projectile 14 after the projectile 14 passes through the orifice 54. In the exemplary embodiment in FIGS. 1, 5, and 7, the return device 50 includes piping 56 extending from the panel 44 to the tossing area 52. Multiple branch pipe sections 58 are coupled to multiple orifices 54 in the panel 44, which all feed to a main pipe section 60 that leads back to where the player is standing in the tossing area 52, with the projectiles 14 collecting in an open pipe section 62. It should be noted that this is only one exemplary embodiment, and various types of return devices 50 could be used, such as ramps, funnels, and shooters, as well as combinations of such return devices 50, to return the projectile 14 to the player. In another possible embodiment, the return device 50 could be omitted and the collector 18 is in the form of walls, funnels, buckets, containers, or combinations thereof coupled to the target 12. In such an embodiment, the projectiles 14 will be collected at or under or on the target 12 and the player has to go and retrieve the projectiles 14 for further play.

In the exemplary embodiment in FIG. 2, the collector 18 includes a guide 64 projecting from the play surface 20. The guide 64 is designed to direct the movement of the projectile 14 moving along the play surface 20. For example, in the exemplary embodiment in FIG. 2, a curved wall 66 is positioned near the bottom of the play area, which curved wall 66 can collect projectiles 14 that are rolling or sliding across the play area, as is well known in many tossing games. The collector 18 could also include additional walls or barriers, such as the smaller curved walls 66 adjacent the orifices 54 as shown in FIG. 2.

As shown in the figures, the toss game assembly 10 can include one or more of the various components described herein. In the exemplary embodiment in FIGS. 2 and 3, there are multiple impact-responsive elements 16 supported on multiple projections 42, multiple guides 64, multiple orifices 54, and multiple branch pipe sections 58. These components can be varied in number and style to achieve virtually limitless possible configurations of the toss game assembly 10. Therefore, when one of these components is mentioned herein, it should be understood as referring to one or multiples of such components to achieve different configurations for different play experiences, including different effects, scoring, and strategy, as is well known in tossing or projectile-based games.

FIG. 8 shows how the toss game assembly 10 would be used. A player stands in the tossing area 52 and throws the projectile 14, in this case the ball 30, with the goal of either striking one of the impact-responsive elements 16 or sending the projectile 14 into one of the orifices 54. Different actions could be assigned different points. If the projectile 14 strikes the impact-responsive element 16, the strike plate 36 is driven into the impact-responsive novelty pyrotechnic 26. If the projectile 14 hits with sufficient force, the strike plate 36 will detonate the shock-sensitive explosive compound to produce a small explosion, which in turn will ignite the nitrocellulose paper 28. The pyrotechnic effect 24 will be a popping sound from the small explosion combined with the flash of flame from the nitrocellulose paper 28. The projectiles 14 would then be collected via one of the orifices 54 and returned to the player via the return device 50.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toss game assembly comprising:

a target, the target having a play surface;

a projectile, the projectile being configured to be tossed onto the play surface;

an impact-responsive element, the impact-responsive element being coupled to the target and positioned on the play surface, the impact-responsive element including a pyrotechnic material being configured to produce a pyrotechnic effect when the impact-responsive element is struck by the projectile;

a collector, the collector being coupled to the target, the collector being configured to collect the projectile moving along the play surface after being tossed for retrieval and reuse;

wherein the impact-responsive element includes a strike plate; and wherein the pyrotechnic material is placed under the strike plate such that when the strike plate is struck by the projectile the pyrotechnic material is triggered to produce the pyrotechnic effect.

2. The toss game assembly of claim 1, wherein the pyrotechnic material is configured to produce a sound and a flame when triggered.

3. The toss game assembly of claim 2, wherein the pyrotechnic material includes an impact-responsive novelty pyrotechnic and a nitrocellulose paper positioned immediately adjacent the impact-responsive novelty pyrotechnic.

4. The toss game assembly of claim 2, further comprising a plurality of the impact-responsive elements spaced apart on the play surface.

5. The toss game assembly of claim 4, wherein:

the target includes a panel and a perimeter wall coupled to the panel to define the play surface on the panel;

the panel includes a plurality of orifices through which the projectile may pass for at least one of scoring and collection;

the collector includes a return device configured to return the projectile to a tossing area;

the return device is coupled to the panel beneath the orifice to receive the projectile after the projectile passes through the orifice;

the return device includes piping extending from the panel to the tossing area;

the collector includes a guide projecting from the play surface; and the guide is configured to direct the movement of the projectile moving along the play surface.

6. The toss game assembly of claim 1, wherein:

the impact-responsive element includes a base plate coupled to the target and a hinge coupled to the base plate;

the strike plate is pivotably coupled to the base plate by the hinge;

the pyrotechnic material is positioned between the strike plate and the base plate; and the strike plate is pivotable for insertion of the pyrotechnic material between the strike plate and the base plate and for removal of the pyrotechnic material after use.

7. The toss game assembly of claim 1, further comprising a projection, the projection being coupled to the target and projecting from the play surface, the impact-responsive element being supported on the projection a distance from the play surface.

8. The toss game assembly of claim 1, wherein:

the projectile is a ball; and the ball is weighted to increase the force generated by the ball when striking the impact-responsive element.

9. The toss game assembly of claim 1, wherein the target includes a panel and a perimeter wall coupled to the panel to define the play surface on the panel.

10. The toss game assembly of claim 9, wherein the panel includes an orifice through which the projectile may pass for at least one of scoring and collection.

11. The toss game assembly of claim 9, wherein the panel includes fire-resistant material or a fire-resistant coating.

12. The toss game assembly of claim 9, further comprising a cushioning material being positioned on the panel, the cushioning material being configured to minimize bounce of the projectile after impact on the panel and to minimize sound produced by the projectile striking the panel.

13. The toss game assembly of claim 1, wherein:

the collector includes a return device configured to return the projectile to a tossing area; and the return device is coupled to the panel beneath the orifice to receive the projectile after the projectile passes through the orifice.

14. The toss game assembly of claim 13, wherein the return device includes piping extending from the panel to the tossing area.

15. A toss game assembly comprising:

a target, the target having a play surface;

a projectile, the projectile being configured to be tossed onto the play surface;

an impact-responsive element, the impact-responsive element being coupled to the target and positioned on the play surface, the impact-responsive element including a pyrotechnic material being configured to produce a pyrotechnic effect when the impact-responsive element is struck by the projectile, wherein the pyrotechnic material is configured to produce a sound and a flame when triggered, wherein the pyrotechnic material includes an impact-responsive novelty pyrotechnic and a nitrocellulose paper positioned immediately adjacent the impact-responsive novelty pyrotechnic;

a collector, the collector being coupled to the target, the collector being configured to collect the projectile moving along the play surface after being tossed for retrieval and reuse; and wherein the nitrocellulose paper is folded over and sealed at the edges to form a packet with the impact-responsive novelty pyrotechnic container therein.

16. The toss game assembly of claim 15, wherein:

the impact-responsive element includes a strike plate;

the pyrotechnic material is placed under the strike plate such that when the strike plate is struck by the projectile the pyrotechnic material is triggered to produce the pyrotechnic effect;

the impact-responsive element includes a base plate coupled to the target and a hinge coupled to the base plate;

the strike plate is pivotably coupled to the base plate by the hinge;

the pyrotechnic material is positioned between the strike plate and the base plate;

the strike plate is pivotable for insertion of the pyrotechnic material between the strike plate and the base plate and for removal of the pyrotechnic material after use;

the toss game assembly further comprises a projection, the projection being coupled to the target and projecting from the play surface, the impact-responsive element being supported on the projection a distance from the play surface;

the projectile is a ball;

the ball is weighted to increase the force generated by the ball when striking the impact-responsive element;

the target includes a panel and a perimeter wall coupled to the panel to define the play surface on the panel;

the panel includes an orifice through which the projectile may pass for at least one of scoring and collection;

the panel includes fire-resistant material or a fire-resistant coating;

the target includes a frame coupled to the panel to hold the panel at an angle to the horizontal;

the toss game assembly further comprises a cushioning material being positioned on the panel, the cushioning material being configured to minimize bounce of the projectile after impact on the panel and to minimize sound produced by the projectile striking the panel;

the collector includes a return device configured to return the projectile to a tossing area;

the return device is coupled to the panel beneath the orifice to receive the projectile after the projectile passes through the orifice;

the return device includes piping extending from the panel to the tossing area;

the collector includes a guide projecting from the play surface; and the guide is configured to direct the movement of the projectile moving along the play surface.

17. A toss game assembly comprising:

a target, the target having a play surface;

a projectile, the projectile being configured to be tossed onto the play surface;

an impact-responsive element, the impact-responsive element being coupled to the target and positioned on the play surface, the impact-responsive element including a pyrotechnic material being configured to produce a pyrotechnic effect when the impact-responsive element is struck by the projectile;

a collector, the collector being coupled to the target, the collector being configured to collect the projectile moving along the play surface after being tossed for retrieval and reuse;

wherein the collector includes a guide projecting from the play surface; and wherein the guide is configured to direct the movement of the projectile moving along the play surface.

* * * * *